US006715734B1

(12) United States Patent
Wise

(10) Patent No.: US 6,715,734 B1
(45) Date of Patent: Apr. 6, 2004

(54) CABINET AND MILL WORK FINISH BAR

(76) Inventor: Robert W. Wise, 365 Ely Rd., Petaluma, CA (US) 94954

( * ) Notice: Subject to any disclaimer, the term of this patent is extended or adjusted under 35 U.S.C. 154(b) by 0 days.

(21) Appl. No.: 09/972,405

(22) Filed: Oct. 5, 2001

(51) Int. Cl.[7] ..... B66F 15/00; B25C 11/00
(52) U.S. Cl. ..... 254/25; 7/166; 81/45
(58) Field of Search ..... 254/25, 18, 21, 254/131, 131.5; 7/166; 81/45, 46; 30/169

(56) References Cited

U.S. PATENT DOCUMENTS

| | | | | | |
|---|---|---|---|---|---|
| 96,700 | A | * | 11/1869 | Howard | 254/25 |
| 3,134,574 | A | * | 5/1964 | Reuterfors | 254/25 |
| D252,787 | S | * | 9/1979 | Jefferson | D7/696 |
| D284,161 | S | * | 6/1986 | DeLano | D8/33 |
| D296,656 | S | * | 7/1988 | Johnson, Sr. | D8/89 |
| D318,005 | S | * | 7/1991 | Ryan et al. | D8/14 |
| 5,695,171 | A | * | 12/1997 | Shine | 254/25 |
| 5,695,172 | A | * | 12/1997 | Hreha | 254/25 |
| 5,768,956 | A | * | 6/1998 | Coonrad | 81/20 |
| D466,381 | S | * | 12/2002 | Joseph | D8/18 |

* cited by examiner

*Primary Examiner*—Joseph J. Hail, III
*Assistant Examiner*—Daniel Shanley
(74) *Attorney, Agent, or Firm*—Seed IP Law Group PLLC

(57) ABSTRACT

An improved pry bar for cabinetry and mill work in the form of a finishing bar has a substantially constant taper from a first sharpened end to second, distal end. The second distal end also has a projection which is substantially normal to the main body of the finishing bar which, itself, consists of a substantially constant taper to a sharpened end point. The constant taper of the main body is in the form of a U-shaped channel terminating in the second end so as to define an aperture thereat. A carpenter or cabinet/mill work installer can place a finger within the aperture and into the channel to remove the finishing bar from underneath a cabinet, mill work or the like.

11 Claims, 2 Drawing Sheets

CABINET AND MILL WORK FINISH BAR

TECHNICAL FIELD

The invention relates to manual tools for carpentry work. More specifically, the invention relates to pry bar tools for use in the alignment of cabinetry and mill work during installation of the same.

BACKGROUND OF THE INVENTION

During the installation of prefabricated cabinets in kitchens, bathrooms, and the like, it is necessary for the carpenter installing the cabinets to align those cabinets so as to be level with respect to the floor on which the cabinets reside. This is important to prevent objects placed on top of the cabinet surface (e.g., countertop, etc.) to remain stationary, rather than roll off an edge thereof. The top of the cabinets themselves are substantially parallel to the bottom of the pre-manufactured cabinet unit. Nevertheless, the floor on which the cabinet is installed may not itself be level with respect to ground. Therefore, carpenters and contractors typically insert a wooden shim underneath the cabinet so as to level the cabinet prior to permanent fixation of the cabinet with the shim to the floor and/or adjacent wall. Normally, a cabinet installer will use a pry bar to elevate the cabinet to a level height prior to inserting the shim underneath the cabinet. Once the wooden shim has been initially inserted under the cabinet, the shim is typically tapped into place by the installer. The wooden shim typically deforms during this operation and the pry bar can then be removed and the cabinet fixed in place. A conventional pry bar of the type utilized in the prior art is illustrated in FIGS. 1 and 2 of the drawings. The pry bar has an elongated main body as shown in FIGS. 1 and 2 and, in side elevation, has the appearance of an elongated "L". The elongated portion of the main body typically has a sharpened end which tapers outwardly with respect to the main body. This end can be used as a scraper in addition to facilitating insertion of the pry bar under the cabinet. The other end of the pry bar typically has an upwardly directed leg which is also sharpened for use as a paint scraper or the like. The pry bar is typically provided with a hole adjacent to the projecting leg for the removal of nails and the like.

The shimming action described above is also used when installing crown mouldings, base boards, and other trim materials where the surface plane of the moulding needs to be alined with a reference surface (e.g., floor, wall or ceiling). The use of the prior art pry bars allow the installer to aline the moulding prior to permanently affixing the moulding to the adjacent substrate.

Prior art pry bars as shown in FIGS. 1 and 2 are also used to adjust doors with respect to their openings, whereby the doors are affixed to the openings through their hardware (e.g., hinges, closers, etc.). By either using the long end of the prior art pry bar with the sharpened end (often termed a "graduated shim") or by using the short 90 degree end, the door can be elevated to the proper height. Obviously, when using the short 90 degree end to lift the door, significant lever action is obtained due to the moment arm length of the elongated portion of the pry bar. The shimming action of the prior art pry bars can also be used in remodeling, where a strong, non-deforming shim is required to adjust framing heights, to split framing apart, to remove existing framing, etc. As stated above, pry bars can also be used as scrapers, removing excess or old paint, caulking, nails, etc.

Nevertheless, certain difficulties are associated with the use of the prior art pry bar shown in FIGS. 1 and 2. It is often difficult to remove the pry bar from underneath the cabinet once the cabinet has been elevated to an appropriate position and a permanent shim installed. As shown in FIGS. 1 and 2, the prior art pry bar has a substantially constant thickness, except for the sharpened portion at the ends thereof. Thus, the pry bar does not provide any substantially range of vertical adjustment of the cabinet or mill work unless an additional shimming object is used underneath the pry bar itself. Thus, a need exists for an improved pry bar which provides a greater range of shimming action and which is easily removable from a cabinet or moulding (a "work piece") after permanent installation of a wooden shim or the like.

SUMMARY OF THE INVENTION

It is therefore an object of the present invention to provide an improved finishing bar for use with respect to cabinetry, mill work and the like which provides a large range of shimming action.

It is a further object of the present invention to achieve the above object with a finishing bar which is easily removed from a work piece once the work piece has been permanently installed.

The invention achieves these objects and other objects and other objects and advantages of the invention which become apparent from the description which follows by providing a finishing bar having an elongated main body, having a substantially tapered first end, and at a distal second end a second wedge-shaped portion projecting substantially normal to the main body. The main body further defines a substantially arch-shaped channel beginning at the first end of the main body and gradually increasing in height toward the second so as to define an aperture at the second end in the wedge-shaped portion. The aperture is adapted for receiving a user's finger for removal of the finishing bar from the work piece or application.

In the preferred embodiment of the invention, the first end and the wedge-shaped portion are sharpened to facilitate using the finishing bar as a scraper. In addition, the main body further defines an aperture adjacent to the first end for use in removing nails. The main body is preferably manufactured from forged steel, and can be provided with a substantially narrowed waist portion between the first and second ends of the main body.

DETAILED DESCRIPTION OF THE PREFERRED EMBODIMENTS

Figure 1:
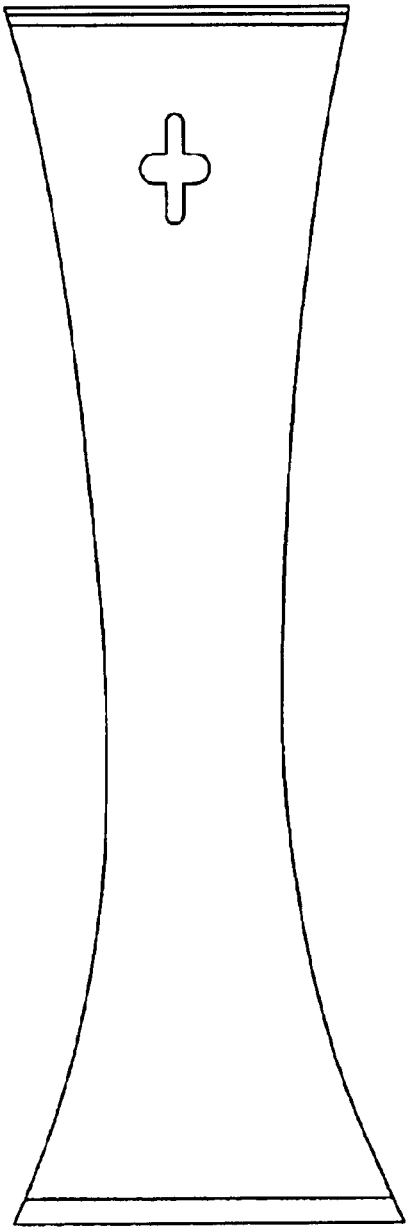
FIG. 1 (Prior Art)
FIG. 1 is a top plan view of a prior art pry bar.
Figure 2:
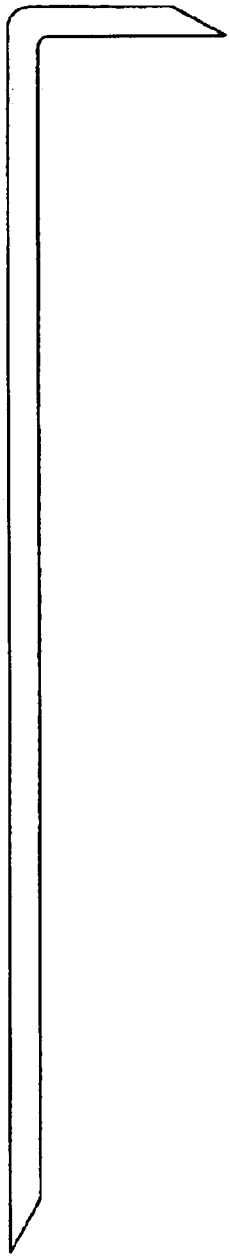
FIG. 2 (Prior Art)
FIG. 2 is a side elevational view of the pry bar of FIG. 1.
Figure 3:
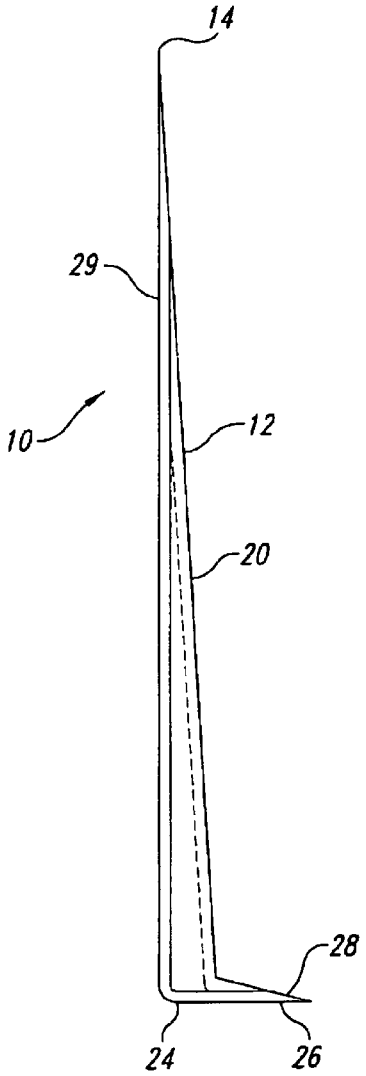
FIG. 3 is a side elevational view of the present invention.
Figure 4:
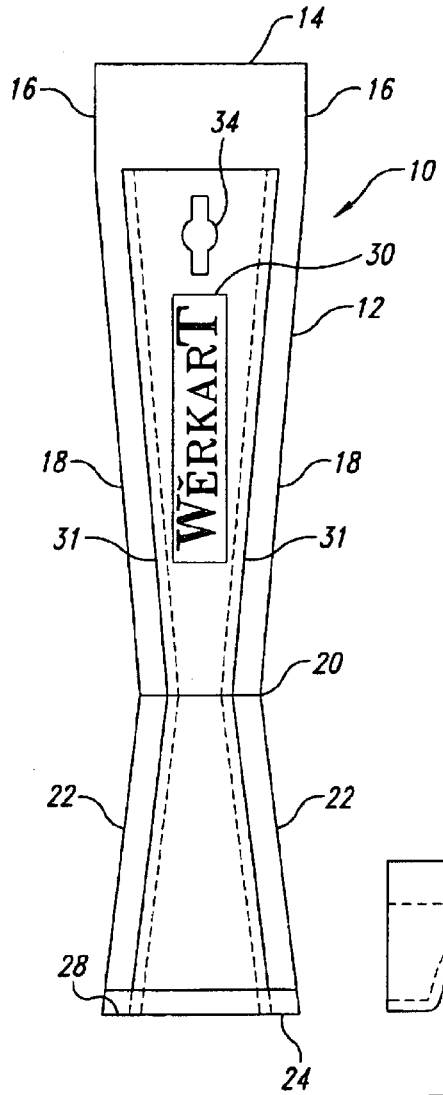
FIG. 4 is a top plan view of the invention.
Figure 5:
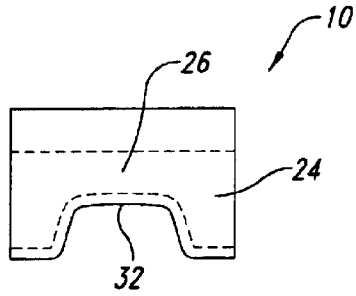
FIG. 5 is an elevational end view of the invention.

A finish bar (or finishing bar) is generally indicated at reference numeral 10 in FIGS. 3 through 5. The finishing bar 10 has a main body 12 approximately 8 inches long. A first end 14 of the main body has substantially parallel sides 16 and is substantially sharp at the first end. The main body 12 further has a pair of inwardly tapering sides 18 which are cojoined at a narrow waist portion 20 to outwardly expanding sides 22, which terminate at a distal, second end 24. The second end 24 has an upwardly projecting wedge-shaped projection 26 which itself terminates in a sharpened edge 28. The main body 12 has a planar undersurface or underside 29 for supporting the finishing bar against a substrate (e.g., the floor onto which a cabinet is to be installed). The main body further includes between first end 14 and second end 24 a substantially arch-shaped channel 30 which initiates adjacent to the first end 14 and terminates at the second end 24 so as to form an aperture or archway 32 at the second end 24. As best seen in FIG. 3, the arch-shaped channel 30 provides a substantially continuous taper from the first end 14 to the second end 24 wherein the outer height of the channel is approximately 0.625" at the second end 24. This substantially constant, gradual taper provides a wide range of shimming heights for use by a cabinet installer when using the finish bar 10 in connection with the leveling of a kitchen or bathroom cabinet or the like. The arch-shaped channel itself has side walls 31 which substantially follow and are parallel with the inwardly and outwardly tapering sides 18, 22 of the main body 12.

The wedge-shaped projection 26 itself projects an additional approximately ½" above the outside of the arch-shaped channel 30 at the second end 24 and forms a substantially gradual taper therefrom to the sharpened edge 28 to provide strength to the wedge-shaped projection 26.

A carpenter or cabinet/mill work installer may use the finishing bar by inserting the first end 14 underneath a cabinet or the like which is to be leveled. A hammer or the like may be used to tap on the second end 24 of the finishing tool 10 while the underside 29 is in contact with the floor and the outside of the arch-shaped channel 30 is in contact with the underside of the cabinet. Once the cabinet has been leveled, a conventional wooden shim or the like is positioned underneath the cabinet in the conventional manner, and a cabinet/wooden shim combination is permanently attached to the floor. The finishing bar 10 may then be removed from the attached cabinet by placing a finger in the aperture 32 to assist in removing the finishing bar.

The finishing bar 10 may also be provided with a nail hole 34 in the arch-shaped channel 30 adjacent to the first end 14 for removal of nails in the conventional manner.

Those of ordinary skill in the art will conceive of other embodiments and modifications of the invention which are within the spirit of the above disclosure. Therefore, the invention is not to be defined by the description above but is to be determined in scope by the claims which follow.

I claim:

1. A finishing bar for cabinetry work comprising:

an elongated main body having a substantially tapered first end and at a distal second end a second wedge shaped portion projecting substantially normal to the main body, the main body further defining a substantially convex arch shaped channel beginning adjacent to the first end and gradually increasing in height towards the second end so as to define an aperture at the second end in the wedge shaped portion, wherein the aperture is adapted for receiving a user's finger for removal of the finishing bar from an application.

2. The finishing bar of claim 1, wherein the first end and the wedge shaped portion are sharpened to facilitate use of the finishing bar as a scraper.

3. The finishing bar of claim 2, wherein the main body further defines a nail removing aperture adjacent to the first end, the nail removing aperture having a substantially circular central area and a pair of diametrically opposed wing portions for receipt of a nail shank.

4. The finishing bar of claim 1, wherein the main body further defines a nail removing aperture adjacent to the first end, the nail removing aperture having a substantially circular central area and a pair of diametrically opposed wing portions for receipt of a nail shank.

5. The finishing bar of claim 1, wherein the main body is manufactured from forged steel.

6. The finishing bar of claim 1, wherein the main body has a substantially horizontally narrowed waist portion intermediate the fist and second ends thereof.

7. A finishing bar, comprising an elongated main body having a tapered first end and at a distal second end a second wedge shaped portion projecting at a preselected angle with respect to the main body, the main body further defining an arch shaped channel defining an aperture at the second end in the wedge shaped portion adapted for receiving a user's finger to facilitate removal of the finishing bar from an application.

8. The finishing bar of claim 7, wherein the first end and the wedge shaped portion are sharpened to facilitate use of the finishing bar as a scraper.

9. The finishing bar of claim 7, wherein the main body further defines a nail removing aperture adjacent to the first end, the nail removing aperture having a substantially circular central area and a pair of diametrically opposed wing portions for receipt of a nail shank.

10. The finishing bar of claim 7, wherein the main body is manufactured from forged steel.

11. The finishing bar of claim 7, wherein the main body has a substantially horizontally narrowed waist portion intermediate the fist and second ends thereof.

* * * * *